US005397198A

United States Patent [19]

Bertrand

[11] Patent Number: 5,397,198

[45] Date of Patent: Mar. 14, 1995

[54] VIBRATORY COMPACTOR HAVING VIBRATIONALLY TUNED FRAME

[75] Inventor: Ludovic A. Bertrand, Movy, France

[73] Assignee: Caterpillar Paving Products Inc., Minneapolis, Minn.

[21] Appl. No.: 117,456

[22] Filed: Sep. 7, 1993

[51] Int. Cl.[6] ..... E01C 19/28

[52] U.S. Cl. ..... 404/117; 404/122; 188/378

[58] Field of Search ..... 404/133.05, 133.1, 122, 404/130, 114, 117; 188/378

[56] References Cited

U.S. PATENT DOCUMENTS

| | | | |
|---|---|---|---|
| 4,221,499 | 9/1980 | Breitholz et al. | 404/117 |
| 4,395,809 | 8/1983 | Whiteley | 188/378 X |
| 4,402,174 | 9/1983 | Boone | 188/378 X |
| 4,619,552 | 10/1986 | Sadahiro | 404/117 |

FOREIGN PATENT DOCUMENTS

| | | | |
|---|---|---|---|
| 0459062 | 12/1991 | European Pat. Off. | 404/117 |

*Primary Examiner*—Ramon S. Britts
*Assistant Examiner*—James A. Lisehora
*Attorney, Agent, or Firm*—Frank L. Hart

[57] ABSTRACT

A vibratory compacting machine has a supplemental member resiliently mounted on the frame of the compacting machine. The supplemental member has a resonant frequency that is substantially equal to the operating frequency of the vibratory compactor and effectively reduces the frame vibration. As a result of reduced frame vibration, the present invention provides increased operator comfort and extended service life of electronic, electrical and mechanical components mounted on the compacting machine.

6 Claims, 1 Drawing Sheet

VIBRATORY COMPACTOR HAVING VIBRATIONALLY TUNED FRAME

TECHNICAL FIELD

This invention relates generally to a vibratory compacting machine, and more particularly to a vibratory compacting machine in which its frame is vibrationally attenuated.

BACKGROUND ART

Vibratory compactors typically comprise a plate or drum that is oscillated or vibrated to impose compaction forces on a densifiable surface, such as ground soil, roadway base material, or paving material. Generally the plate or drum member is resiliently mounted on the frame of the compactor to reduce the vibration forces transmitted, through the frame, to other components of the machine.

However, resiliently mounting the vibrating member on the vehicle has been only partially effective because of the inherent physical limitations associated with such mounting arrangements. If the spring rate, or stiffness, of the resilient attachment elements is too low, the machine may be difficult to control and the compaction forces transmitted to the compactible material may be undesirably affected, A high spring rate may produce excessive vibration of the frame and machine components mounted on the frame, such as bearings, drive train elements and the operator's station. Therefore, the amount of vibration isolation between the compacting element and the frame of the compactor has heretofore been a compromise in which neither compaction efficiency and machine controllability nor wear on machine elements and operator comfort could be optimized without undesirably affecting each other.

The present invention is directed to overcoming the problems set forth above. It is desirable to have an apparatus that will attenuate the vibrational forces transmitted by the frame of a vibratory compactor to other components of the machine. It is also desirable to have such an apparatus that will not adversely affect the interaction of the actively vibrated member with the material being compacted.

DISCLOSURE OF THE INVENTION

In accordance with one aspect of the present invention, a compacting machine having a frame, a material contacting member, and means for vibrating the material at a predetermined operating frequency, includes a supplemental member and a plurality of resilient mounting members connecting the supplemental member to the frame. The resilient mounting members have a spring rate that is selected to cooperate with the mass of the supplemental member so that the mounted supplemental member has a resonant frequency that is substantially equal to the operating frequency of the material contacting member.

BEST MODE FOR CARRYING OUT THE INVENTION

Figure 1:
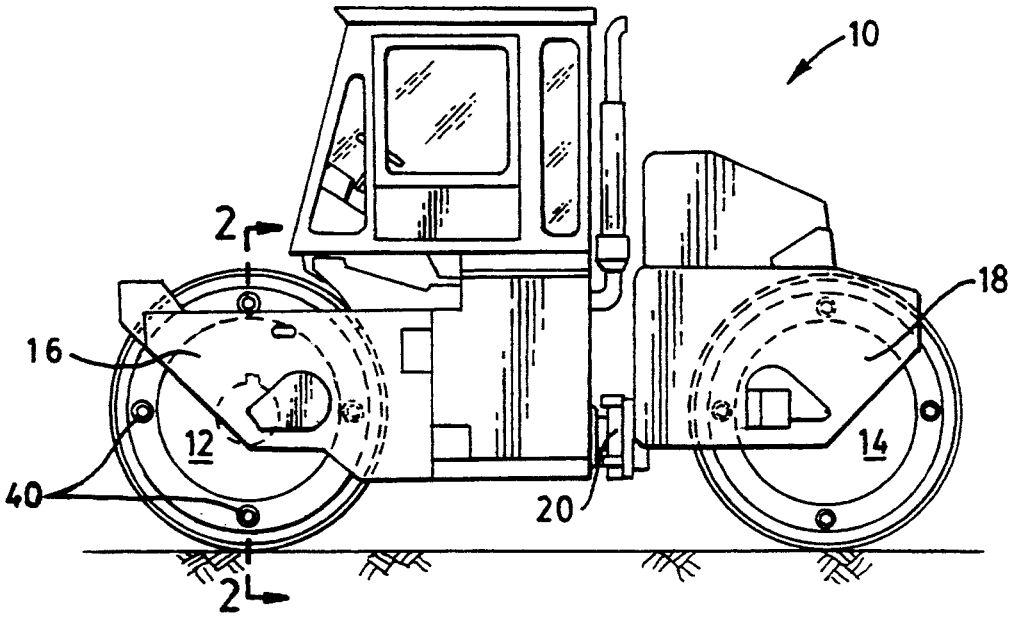
FIG. 1 is a side view of a vibratory compactor embodying the present invention.

A representative vibratory compactor 10 embodying the present invention is, as shown in FIG. 1, is a tandem drum compactor having a front material contacting member 12 and a rear material contacting member 14, each of which are rotatably mounted on a respective frame member 16,18. The frame members 16,18 are pivotally connected to each other at a pivot joint 20. The compactor 10 is steered by moving one of the frame members 16,18 with respect to the other by hydraulic cylinders, not shown.

Figure 2:
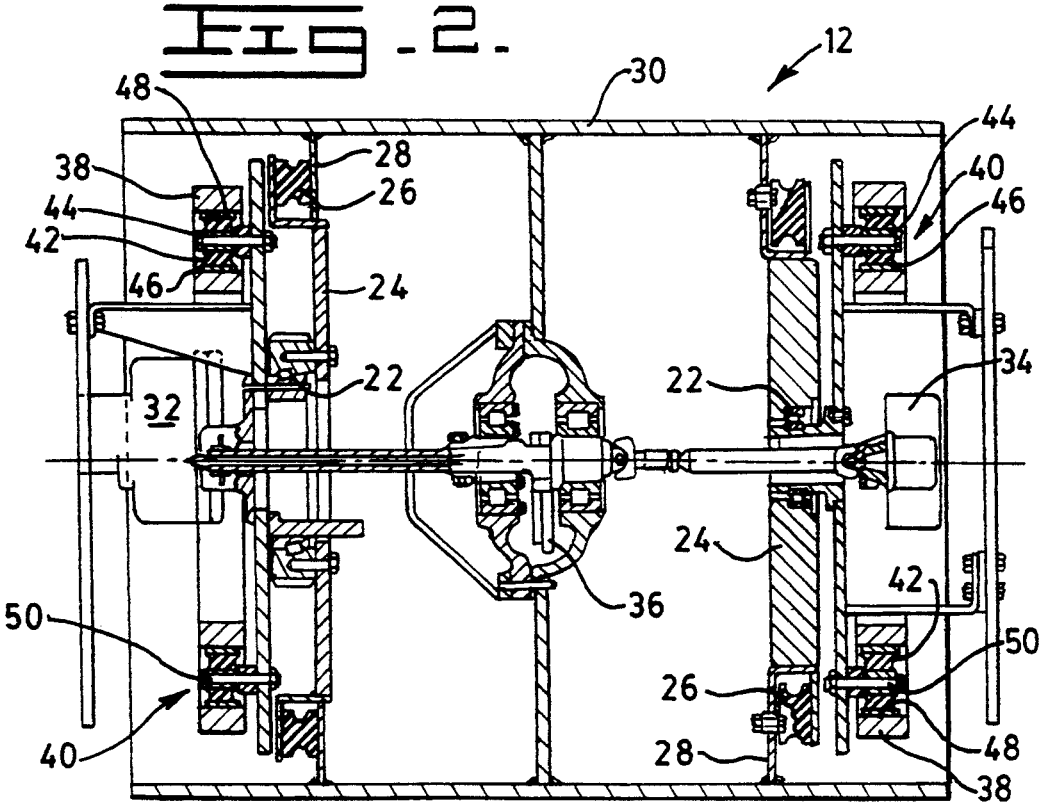
FIG. 2 is a sectional view of a material contacting member of the vibratory compactor taken along the line 2—2 of FIG. 1.

In the tandem drum arrangement shown in FIG. 1, the front and rear material contacting members 12,14 are similar in construction. For the sake of brevity, the following description of the preferred embodiment of the invention is described with reference to the front drum member 12, as shown in FIG. 2. The description of the construction and elements comprising the front drum 12 applies equally to the rear drum 14. In a single drum arrangement the following description applies to the single drum.

As shown in FIG. 2, the material contacting member 12 is rotatably supported on the frame member 16 by a pair of bearing assemblies 22. A flange 24 extends outwardly from each of the bearing assemblies 22 and is connected, through a plurality of resilient connectors 26 to web members 28 supporting an outer shell 30 of the material contacting member 12. A propel motor 32 rotates the outer shell 30 and associated support structure 24,26,28 to propel the compactor 10. The material contacting member 12 includes a second motor 34 which controllably rotates an eccentric mass 36 to impart vibratory motion at a controllable operating frequency $f_o$ to the outer shell 30 of the material contacting member 12.

In the preferred embodiment of the present invention, the compacting machine 10 includes at least one supplemental member resiliently mounted to the frame. As shown in FIG. 2, the supplemental member comprises a pair of annular rings 38, one on each side of the drum 12. Each of the annular rings 38 are connected to the frame by a plurality of resilient mounting members 40. Desirably, the supplemental members are mounted on the frame at a position near the point where the vibratory motion is introduced, that is, as close to the source of vibration as practical. In the preferred embodiment, the supplemental members 38 are resiliently mounted on a portion of the frame adjacent the supports for the bearing assemblies 22. The supplemental members may be positioned at other locations on the frame with varying degrees of effectiveness. The effectiveness of alternate positions may be determined experimentally, empirically, or by analysis of a computer-generated model of a compactor/supplemental mass system. Also, as will described later in more detail, it is desirable that the weight, or more accurately the mass $M_s$ of the supplemental members 38 should be at least about 5%, and no more than about 20%, of the mass $M_f$ of the frame member 16. Preferably, the mass $M_s$ of the supplemental members is about 10% of the mass $M_f$ of the frame member 16.

The resilient mounting members 40 preferably are constructed of an elastomeric material such as rubber or similar material that will provide vibration damping as well as dynamic compliance. In the preferred embodiment, the resilient mounting members 40 comprise an annular elastomeric element 42 sandwiched, or compressed, between an inner bushing 44 and an outer rigid sleeve 46. The outer sleeve 46 is pressed into a bore 48 provided in the supplemental member 38. As shown in FIG. 2, four bores 48 are provided, each spaced at a 90 degree arcuate increment from each other, around each of the supplemental members 38. The supplemental members 38 are attached to the frame by bolts 50 which extend through the inner bushing 44 of each of the resilient mounting members.

When arranged as shown in FIG. 2, the resilient mounting members 40 coact in a parallel fashion to provide compliance, more commonly known as the spring rate K, that is cumulative. That is, the spring rate K, of each resiliently mounted supplemental member 38 is the sum, or total of the spring rates of the four resilient mounting members supporting the supplemental member. The resonant frequency $f_r$ of each of the supplemental members 38 is defined as:

$$f_r = \frac{1}{2\pi} \sqrt{\frac{K}{M_s}} .$$

In carrying out the present invention, it is important that the natural, or resonant, frequency $f_r$ of the resiliently mounted supplemental members 38, be substantially equal to the operating frequency $f_o$ of the compacting machine 10. That is, $f_r \approx f_o$.

Typically, the operating frequency $f_o$ of the compacting machine 10 is a predetermined single frequency or, alternatively, variable over a predetermined limited range of frequencies governed by an automatic frequency controller or by the operator. When the operating frequency $f_o$ of the compacting machine is a preselected range over which $f_o$ may be varied during operation, the spring rate of the resilient mounting members 40 and the mass of the supplemental members 38 are selected so that the resonant frequency $f_r$ of the supplemental member is within the preselected operating range $f_o$.

An important advantage of including elastomeric elements 42 in the resilient mounting members 40 is that the inherent vibration damping properties of the elastomer effectively flatten and broaden the resonant peak of the resiliently mounted supplemental members 38 thereby producing a range of frequencies over which the supplemental members effectively reduce the vibrational energy transferred through the frame 16. Therefore, when the supplemental members 38 are mounted on a compacting machine 10 having a operating frequency $f_o$ that is variable over a preselected range, it is desirable to select a spring rate K of the resilient mounts 40 and a mass $M_s$ of the supplemental members that, according to the above formula, will provide an effective resonant frequency $f_r$ range that is at least partially within the operating frequency range $f_o$ of the compacting machine. Preferably, the mid-point of the effective frame vibration-reducing range of the supplemental member is at the midpoint of the operating frequency range.

In a test of the above described invention, a supplemental member was resiliently mounted on the front frame member of a Caterpillar® CS 563 vibratory compactor. The frame on this machine includes a beam extending transversely across the front of the machine, providing a convenient position for mounting essentially a rectangular steel bar, had a mass $M_s$ of the supplemental member. The mass $M_f$ of the frame was about 2200 kg and the added supplemental member, about 400 kg, or about 18% of the frame mass $M_f$. Each end of the bar was mounted to the frame beam by a pair of elastomeric mounts, acting in series. The total stiffness, or spring rate, K of the resiliently mounted supplemental member was about 7 MN/m. Thus, applying the above formula, the supplemental member had a design, or selected, resonant frequency $f_r$ of about 21 Hz.

During the test, the material contacting drum of the compacting machine was supported on rubber tires positioned, on their sides, between the bottom of the drum and a concrete surface. This was done to provide a reproducible surface and avoid inconsistency in the test data resulting from changes in density of the drum supporting surface during the test. The drum was not rotated during the test. Accelerometers were mounted on the top surface of the drum, on an upper surface of the resiliently mounted supplemental member, and on an upper surface of the frame adjacent the supplemental member. Thus, all of the accelerometers were oriented in the same direction. The drum was vibrated at preselected frequencies, (column 1, below) and measurements of the acceleration of the drum (column 2) and the frame (column 3) were taken and recorded at each frequency. The supplemental mass was then mounted, as described above, on the frame and the test was repeated. Measurements were again taken at each of the preselected frequencies and the acceleration of the resiliently mounted supplemental mass (column 4) and the frame (column 5) were recorded. The recorded acceleration of the drum and frame during the first portion of the test, and of the frame and the supplemental member during the second test portion are as follows:

| | Acceleration (g) | | | |
|---|---|---|---|---|
| (1) Frequency (Hz) | (2) Drum | (3) Frame w/o Supp. Member | (4) Supp. Member | (5) Frame with Supp. Member |
| 17.5 | 2.077 | 1.779 | 0.625 | 0.312 |
| 18 | 2.190 | 1.811 | 0.588 | 0.296 |
| 19.5 | 2.528 | 1.948 | 0.551 | 0.283 |
| 21 | 2.712 | 1.643 | 0.663 | 0.255 |
| 22 | 2.890 | 1.619 | 0.787 | 0.206 |
| 23.5 | 3.301 | 1.766 | 1.123 | 0.271 |
| 24.5 | 3.366 | 1.766 | 1.250 | 0.444 |
| 25.5 | 3.789 | 1.941 | 1.805 | 0.964 |
| 26.5 | 4.059 | 1.843 | 2.706 | 2.251 |
| Average - 17.5–24.5 | 2.723 | 1.762 | 0.798 | 0.295 |

As demonstrated by the above test, the frame acceleration was significantly attenuated, or decreased, over a range of at least 7 Hz (17.5–24.5 Hz), or about ±3.5 Hz either side of the selected resonance frequency $f_r$ of 21 Hz. Over this range, the acceleration of the frame was reduced from an average value of 1.762 g to only 0.295 g, a reduction ratio of 5.9:1. As discussed above, the actual range over which the supplemental member will effectively decrease the vibrational energy of the frame is at least partially dependent on the damping properties of the resilient mounts.

INDUSTRIAL APPLICABILITY

As demonstrated in the above test, the addition of a resiliently mounted supplemental member, embodying the present invention, to the frame of a vibratory compactor significantly reduces the vibration of the frame.

As a result, vibrations transmitted by the frame to other components of the vibratory compactor, such as the operator's platform, electronic logic and electrical control components, and bearing and drive train components are reduced. The present invention not only contributes to the comfort of the machine operator but also reduces vibration induced wear and fatigue on electronic, electrical and mechanical components connected, either directly or indirectly, to the frame of the vibratory compactor.

The present invention is applicable to all types of vibratory compacting machines having a vibrating or oscillating material contacting member carried on a frame. Examples of such vibratory compacting machine include plate compactors, vibrating screeds for paving machines, and single and tandem drum compactors, including split drum arrangements. Such machines may be self-propelled, towed, or walk behind hand operated machines.

Other aspects, features and advantages of the present invention can be obtained from a study of this disclosure together with the appended claims.

I claim:

1. A compacting machine comprising a frame, a material contacting member including means for compacting a densifiable surface, said material contacting member being mounted on said frame, means for vibrating said material contacting member at a predetermined operating frequency ($f_o$), a supplemental member having a preselected mass ($m_s$), and a plurality of resilient mounting members connecting said supplemental member to said frame, said mounting members having a spring rate (K) selected to cooperate with the mass ($m_s$) of said supplemental member and define a resonant frequency ($f_r$) characteristic of said supplemental member, said resonant frequency ($f_r$) being substantially equal to the operating frequency ($f_o$) of said material contacting member.

2. A compacting machine, as set forth in claim 1, wherein the predetermined operating frequency ($f_o$) of said material contacting member comprises a preselected range over which said frequency ($f_o$) may be varied during operation, and the resonant frequency ($f_r$) of said supplemental member is within said preselected operating range.

3. A compacting machine, as set forth in claim 2, wherein the resonant frequency ($f_r$) of said supplemental member is at the mid-point of a range of frequencies over which the supplemental member effectively attenuates the vibration of said frame, and at least a portion of said effective range of frequencies are within said preselected operating frequency range.

4. A compacting machine, as set forth in claim 1, wherein said frame has a predetermined mass ($M_f$) and the mass ($M_s$) of said supplemental member is from about 5% to about 20% the value of the mass ($M_f$) of said frame.

5. A compacting machine, as set forth in claim 1, wherein said machine includes at least two supplemental members, each of said supplemental members being resiliently attached to said frame.

6. A compacting machine, as set forth in claim 1, wherein said resilient mounting members include at least one functional component constructed of an elastomeric material.

* * * * *